US012624885B2

(12) United States Patent
Wilkinson

(10) Patent No.: US 12,624,885 B2
(45) Date of Patent: May 12, 2026

(54) RAPID CHILL AND FREEZE CABINET

(71) Applicant: Ken Wilkinson, Spokane, WA (US)

(72) Inventor: Ken Wilkinson, Spokane, WA (US)

( * ) Notice: Subject to any disclaimer, the term of this patent is extended or adjusted under 35 U.S.C. 154(b) by 154 days.

(21) Appl. No.: 18/831,125

(22) Filed: Jul. 30, 2024

(65) Prior Publication Data

US 2025/0044013 A1 Feb. 6, 2025

Related U.S. Application Data

(60) Provisional application No. 63/629,955, filed on Aug. 3, 2023.

(51) Int. Cl.
*F25D 17/06* (2006.01)

(52) U.S. Cl.
CPC ..... *F25D 17/067* (2013.01)

(58) Field of Classification Search
CPC ..... F25D 17/067; F25D 2317/0665; F25D 25/025; F25D 2400/30; F25D 2317/043; F25D 17/062; F25D 17/005; A61F 1/16
See application file for complete search history.

(56) References Cited

U.S. PATENT DOCUMENTS 4,739,625 A * 4/1988 Buchmuller ..... F25D 3/11 165/919
2002/0184895 A1* 12/2002 Anderson ..... F25B 21/04 62/3.6
2004/0194494 A1* 10/2004 Wilkinson ..... F25D 17/005 62/340
2010/0071874 A1* 3/2010 Nojima ..... F25D 17/065 165/61
2011/0016887 A1* 1/2011 Lee ..... F25B 21/02 62/275
2014/0202444 A1* 7/2014 Dobie ..... F24C 15/322 219/400
2022/0170694 A1* 6/2022 Cutting ..... F25D 25/00

FOREIGN PATENT DOCUMENTS

KR 20180123229 A * 11/2018 ..... F25D 23/006

OTHER PUBLICATIONS

KR-20180123229-A Translation (Year: 2018).*

* cited by examiner

*Primary Examiner* — Frantz F Jules
(74) *Attorney, Agent, or Firm* — Reidlaw, L.L.C.; John S. Reid

(57) ABSTRACT

A rapid freeze cabinet includes an open rectangular parallelepiped frame, an open product drawer shelf, and a product drawer slidingly supported on the shelf. The product drawer includes a plurality of product cells having open upper and lower ends, closed sidewalls, and product container support member disposed therein to support a product container therewithin. The cabinet includes a blower supported by the frame, and a cold air distribution system to move air from the blower to nozzles disposed above respective product cells. Plenums house the nozzles, each plenum forming a seal around the upper end of a respective product cell.

5 Claims, 9 Drawing Sheets

RAPID CHILL AND FREEZE CABINET

CROSS REFERENCE TO RELATED APPLICATION(S)

This application claims priority to U.S. Provisional Patent Application Ser. No. 63/629,955, filed Aug. 3, 2023, which is hereby incorporated herein by reference in its entirety.

BACKGROUND

Blood plasma and other biological liquids frequently need to be frozen in order to be stored for extended periods of time, and to facilitate the transport thereof. In order to preserve the biological integrity of the liquid, the freezing process must occur very rapidly. In the case of blood plasma, the industry provides a standard of cooling the plasma from 70 degrees F. to 30 degrees F. in 10 hours or less. The rapid chilling and freezing of blood plasma is oftentimes referred to as snap freezing, although the term flash freezing is sometimes also used (even though the latter process generally is understood to refer to a process of using a liquid bath of nitrogen or other cryogenic fluid to achieve the rapid freezing process). For purposes of this application, I will use the term snap freezing to refer to the rapid freezing of blood plasma and other biological liquids. The process described herein also can be used for rapid chilling (but not necessarily freezing) of biological liquids.

While flash freezing using a cryogenic liquid is one option for freezing biological liquids (when the biological liquid is contained in a liquid-tight container to prevent contamination of the biological liquid), this process does not lend itself well to use in small scale operations. Specifically, the equipment required to store and use a cryogenic liquid is expensive and maintenance-intensive as compared to a chilled air freezer. Also, handling of cryogenic liquids requires special care and training to prevent accidents. Another option to rapidly freeze biological liquids is to place the liquids (i.e., bottles or containers filled with the liquids) inside of a walk-in type freezer. Such freezers are made to operate at sub-zero temperatures and can provide adequate, but non-uniform, freezing times. Specifically, articles placed at different locations within the walk-in freezer compartment can have significantly different freezing times.

A further method for rapid chilling or freezing of blood plasma and biological liquids is to place containers (e.g., bottles) of the liquids in a separate rack or cabinet, which can then be placed inside of a larger primary freezer (such as a walk-in freezer or cooler). This method, and the accompanying apparatus, are described in my U.S. Pat. No. 6,968,712 B2 (issued Nov. 29, 2005). Since that time, industry standards have changed to decrease or control the allowed time for freezing/cooling of blood plasma, and there is a need to increase the efficiency of my previous design by being able to adjust or set the rate of time to freeze or chill the biological liquids.

DETAILED DESCRIPTION

Figure 1:
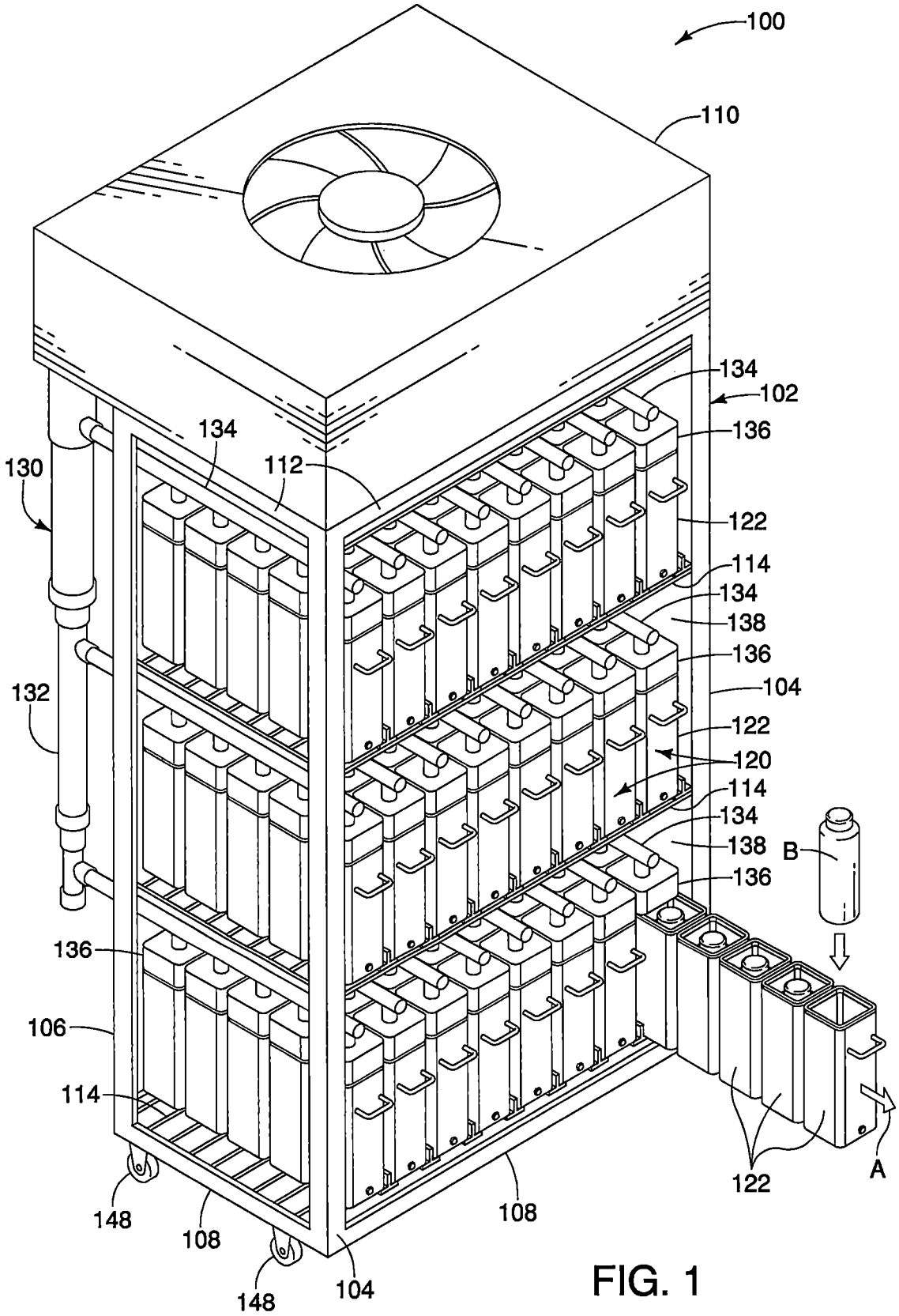
FIG. 1 is an isometric view of a rapid freeze cabinet as provided for herein.

With reference to the accompanying drawings, FIG. 1 is an isometric view of a first embodiment of a rapid freeze cabinet 100 according to the present disclosure. It will be appreciated that the rapid freeze cabinet 100 can also be used for chilling liquids without freezing them, and so can also function as a rapid chill cabinet. That is, the cabinet 100 of FIG. 1 (and other embodiments as provided for herein) can be described as a rapid freeze/chill cabinet, but for the sake of simplifying the following description will be referred to only as a rapid freeze cabinet. The use of "rapid freeze cabinet" to generally describe the present apparatus should not in any way be understood as limiting the use of the cabinet to freezing only. The rapid freeze cabinet 100 of FIG. 1 includes an open frame structure 102 which has, as structural frame members, vertical front frame members 104, which are spaced apart from one another, and vertical rear frame members 106 which are likewise spaced apart from one another as well from the front frame members 104. (Only one vertical rear frame member 106 can be seen in FIG. 1.) Front frame members 104 and rear frame members 106 are held in spaced-apart relationship from one another by four horizontal lower frame members 108 (only two of which can be seen in FIG. 1), which together form a rectangular lower frame assembly. Likewise, front frame members 104 and rear frame members 106 are held in spaced-apart relationship from one another by four horizontal upper frame members 112 (only two of which can be seen in FIG. 1), which together form a rectangular upper frame assembly. Together, the frame members 104, 106, 108 and 110 form a rectangular parallelepiped which is the open frame structure 102 of the rapid freeze cabinet 100. Of note, preferably the rapid freeze cabinet 100 has no side coverings which would restrict the movement of air outward from the cabinet. More preferably, the rapid freeze cabinet does not have a front or rear covering which would also restrict the movement of air outward from the cabinet. More specifically, each opposing side, and the front and rear, of the open frame structure 102 are constructed such that at least 75% of the area defined by each such side, front and/or rear of the open frame structure is open space (i.e., not inhibited by structural members or surface coverings).

The rapid freeze cabinet 100 of FIG. 1 includes a blower 110 which is supported by the upper frame members 112. It will be appreciated that the rapid freeze cabinet is intended to be placed within a larger main freezer or cooler (typically a walk-in freezer or cooler, not shown in FIG. 1). Accordingly, the rapid freeze cabinet 100 does not itself include a refrigeration unit, since the blower 110 uses cold air from the main freezer/cooler to chill and/or freeze product (as will be described in more detail below). The rapid freeze cabinet 100 can thus be described as an air management system for efficiently using main freezer/cooler cold air to achieve rapid chilling and freezing of product placed within the cabinet 100. While the rapid freeze cabinet 100 can be a fixed unit within the larger main freezer/cooler, it can also include wheels 148 to facilitate moving the rapid freeze cabinet into and out of the main freezer/cooler, as well as around inside the main freezer/cooler.

The rapid freeze cabinet 100 houses an array of product drawers 120 which are supported on shelves 114. In the embodiment depicted in FIG. 1, the rapid freeze cabinet 100 includes three such shelves 114, each shelf supporting 8 product drawers 120. The product drawers 120 can be inserted into, and extracted from, the rapid freeze cabinet 100 using drawer pulls 124. One of the drawers 120 is depicted as pulled out (in direction "A") from the cabinet 100 at the lower right of the front of the cabinet. As can be seen, the extracted drawer 120 includes five product cells 122. In the example shown in FIG. 1, the product (not visible) is stored in bottles "B", which can be placed in each individual product cell 122. As will be described below, cold air from a main freezer/cooler is passed through the individual product cells 122 in order to achieve chilling and/or freezing of product within the bottles "B". In order to achieve the desired rapid chilling/freezing, it is desirable that the cold air be passed through the product cell 122 in a rapid and controlled manner, and thus it is further desirable to remove restrictions in the product cell, and the cabinet 100, which could inhibit the flow of air through the product cells 122. To that end, the rapid freeze cabinet 100 is provided with the open frame configuration described above to allow the free flow of air from the product cells 122. Additionally, the shelves 114 are configured to allow the free flow of air from the bottom of the product cells 122, and the cabinet 100 is provided with air outlet openings 138 in the front portion of the cabinet to allow the free exhaust of air from the cabinet 100 to the main freezer/cooler (not shown). The product cells 122 are preferably provided with completely open bottoms (as shown and described in FIG. 2A), with a bottle support rod (144, FIG. 2A) to hold the product bottle "B" in place in the product cell. With further respect to the shelves 114, the shelves can be fabricated from perforated sheet metal or, more preferably, from thin metal rods (e.g., rigid wire, such as chrome plated stainless steel rod of between 1 mm and 5 mm in diameter).

The rapid freeze cabinet 100 provides cold air to the product cells 122 via a cold air distribution system 130, which includes primary cold air supply lines 132 and secondary cold air supply lines 134 (secondary cold air supply lines 132 branching off of the primary cold air supply lines 132 at a ninety degree angle). In FIG. 1 only one of the primary cold air supply lines 132 can be seen. However, it is understood that each vertical array of product drawers 120 is provided with a dedicated primary cold air supply line 132 (thus, in this example, there will be eight primary cold air supply lines running vertically down the back of the rapid freeze cabinet 100). Further, each product drawer 120 is provided with a dedicated secondary cold air supply line 134, such that in the example depicted there will be 40 such secondary cold air supply lines (i.e., one secondary cold air supply line for each of the 40 product drawers). The secondary cold air supply lines 134 provide the cold air to product cell plenums 136, which are arranged to seal against the product cells 122 when the product drawers 120 are inserted into the cabinet 100 (as will be described further below with respect to FIG. 2A). The product supply drawers 120 can be either slidingly fixed within the cabinet 110 (i.e., so that the drawers can be opened for loading and unloading of product bottles "B"), or the product drawers 120 can be removable from the cabinet 100 to allow loading and unloading of product bottles outside of the main freezer/cooler.

Figure 2A:
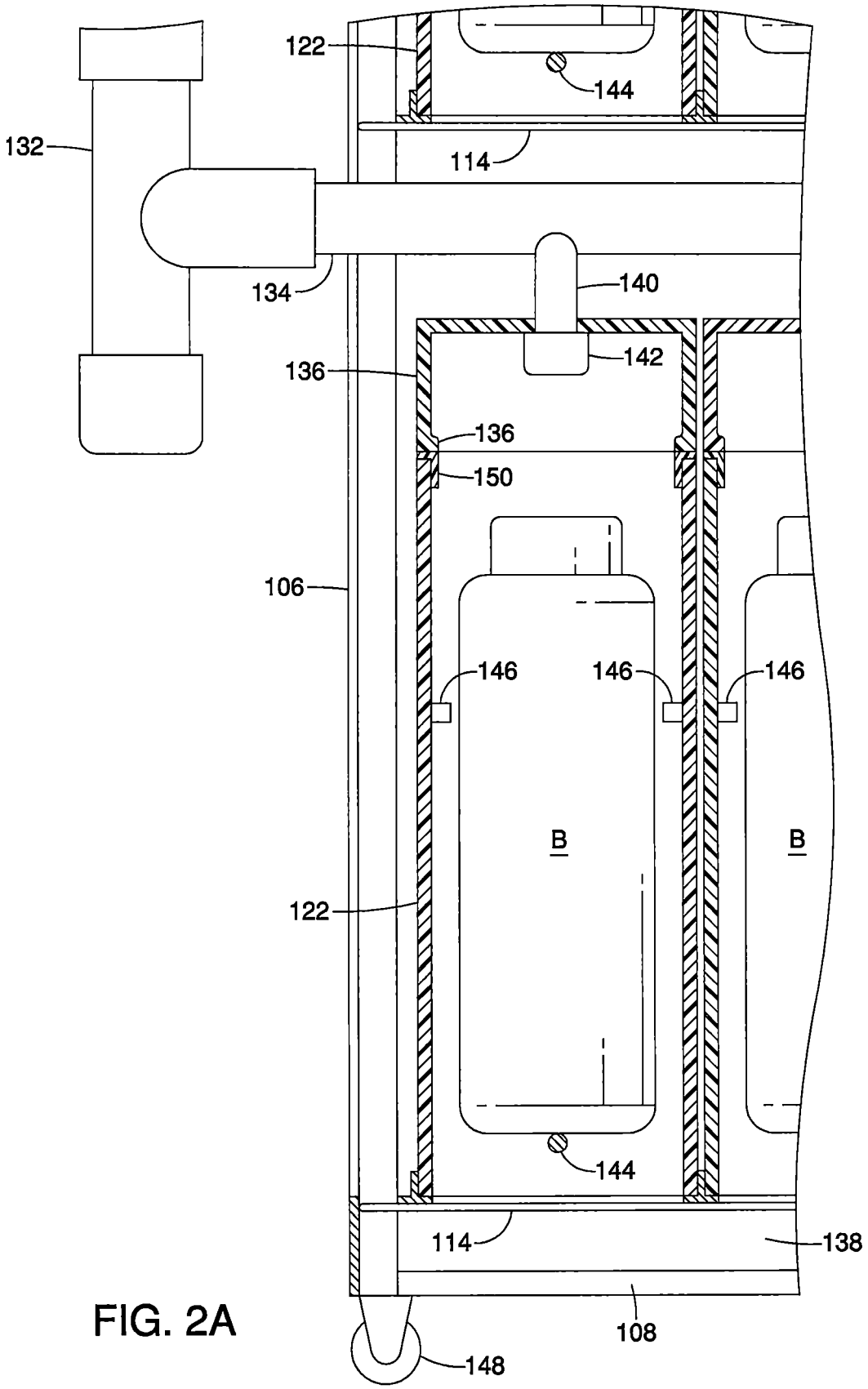
FIG. 2A is a sectional detail of a product cell used in the rapid freeze cabinet of FIG. 1.

Turning now to FIG. 2A, a single product cell 122 of FIG. 1 is depicted in a side sectional detail. This detail depicts a product cell in the lower left rear corner of the rapid freeze cabinet 100 of FIG. 1. In FIG. 2A the product cell 122 is depicted supporting a product bottle "B". The product bottle "B" is held in place in the product cell 122 by a lower arresting rod 144 which transverses the product cell 122 perpendicular to the plane of the drawing. The product bottle "B" is further held in spaced-apart relationship from the inner side walls of the product cell 122 by spacers 146 which are pins attached to the inner walls of the product cell. Two such spacers 146 are depicted in FIG. 2A. The product cell 122 has at least 3 such spacers 146 to hold the product bottle "B" away from the inner walls of the product cell, to allow even flow of air around the bottle (as will be discussed later). Also depicted in FIG. 2A is the lower part of the primary cold air supply line 132 which provides air to the secondary cold air supply line 134. A "T" (or "tee") fitting 140 from the secondary cold air supply line 134 passes through the upper surface of the product cell plenum 136 and connects to cold air discharge nozzle 142. The product cell 122 is provided with a resilient seal 150 about the upper periphery of the product cell, the seal 150 sealing against the lower periphery of the cold air plenum 136 when the product cell 122 is positioned beneath the plenum 136. When the product drawer 120 (FIG. 1) with product cell 122 (FIG. 2A) is extracted from the cabinet 100, the cold air plenum 136 (and air discharge nozzle 142) remain in place within the cabinet 100. When the product drawer 120 is placed within the cabinet 100, the bottom of the product cells 122 rest on the shelves 114 (depicted in FIG. 2A as a rigid wire shelf). Below the shelf 114 is the air discharge opening 138, which is also seen in FIG. 1. Although not visible in FIG. 2A, the cold air discharge nozzle 142 can be provided with a plurality of air openings radially disposed about a center point of the nozzle to facilitate distribution of the air to the space between the product bottle "B" and the sidewall of the product cell 122.

Figure 2B:
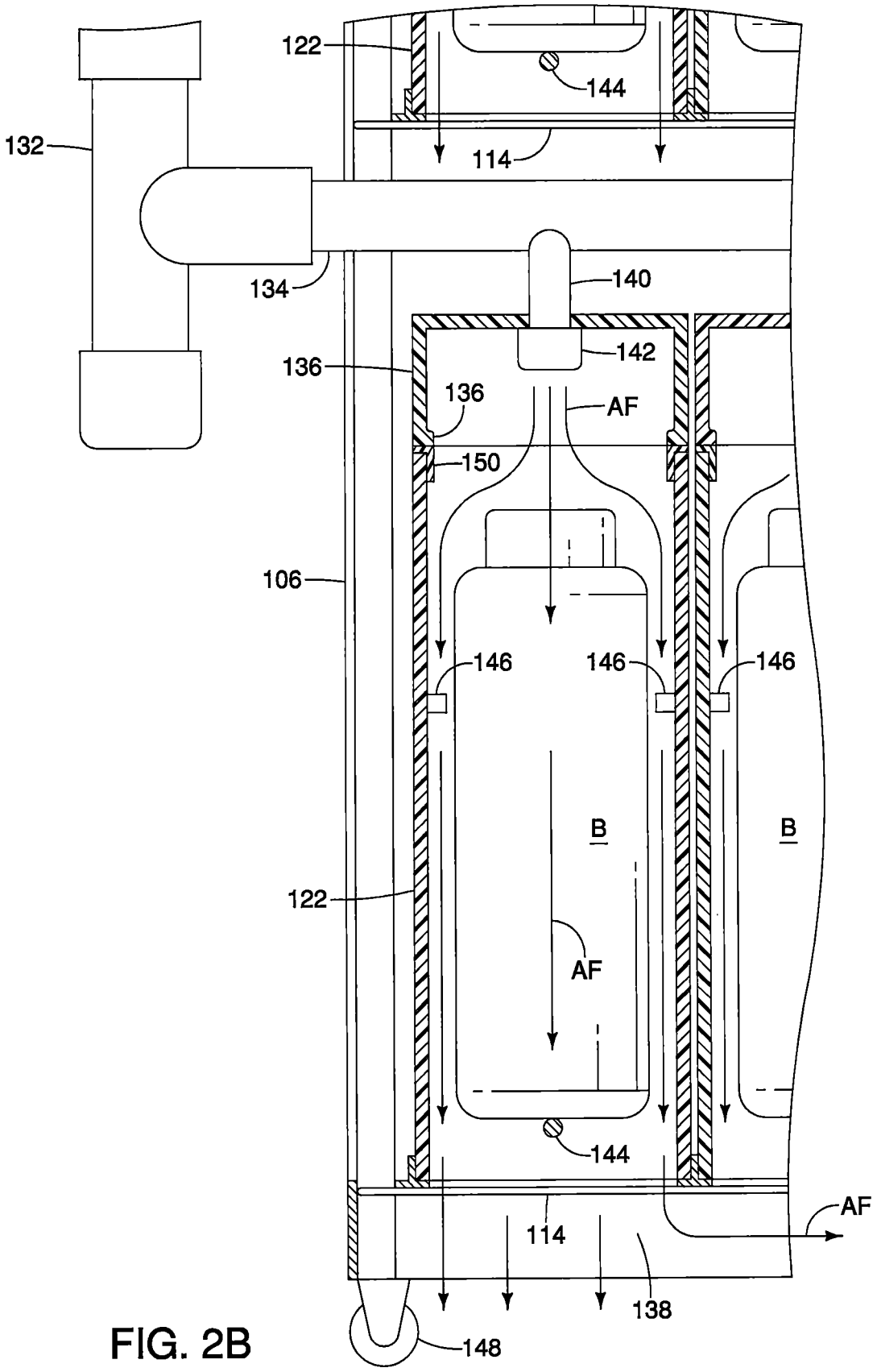
FIG. 2B is the sectional detail of FIG. 2A but showing air flow through the bottle air cell.

Turning now to FIG. 2B, the same detail as in FIG. 2A is shown, but with the addition of airflow lines "AF" so that it can be seen how air flows out of the cold air discharge nozzle 142, down the sides of the product cell 122 and past the walls of the product bottle "B", and out through the air opening 138. In addition to the air flow arrows "AF" depicted in the plane of the drawing of FIG. 2B, there will also be airflow out of the bottom of the product cells 122 in the directions perpendicular to the plane of the drawing. The product cell 122 configuration, and the arrangement of the cabinet 100, allows the free flow of spent chilling air out of the open bottom of the product cell 122. This arrangement increases the rate at which the cold air can extract heat from the product within the product bottles "B".

Figure 3:
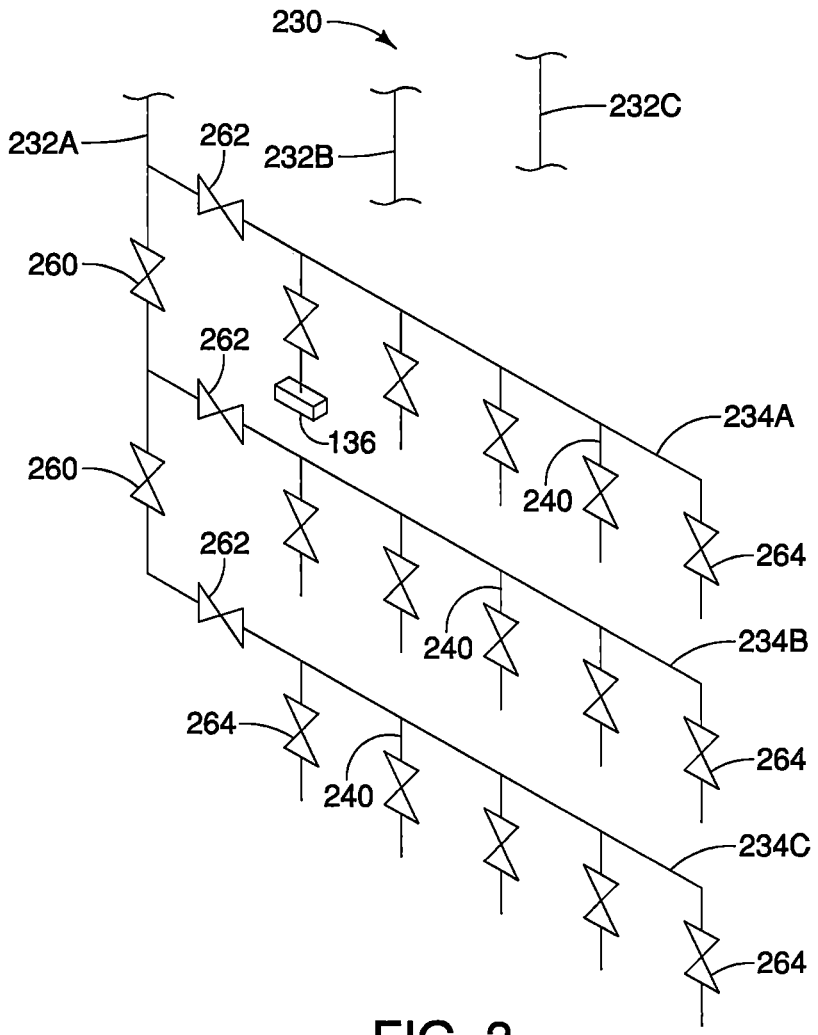
FIG. 3 is an isometric schematic diagram depicting a variation on the cold air distribution system of the rapid freeze cabinet of FIG. 1.

Turning now to FIG. 3, an isometric schematic diagram depicts a variation on the cold air distribution system 130 of the rapid freeze cabinet of FIG. 1. In FIG. 1 the primary cold air supply line 132 is depicted as having a step-wise reduction in diameter as the line 132 descends down the back of the cabinet. This is in recognition of the fact that the volume of air flowing through the primary air supply line 132 is reduced as air is shuttled into the secondary air supply lines 134, and thus smaller diameter lines can be used to transport the air as it moves down the primary cold air supply line 132. It will be appreciated that it is desirable that the amount of cold air flowing from the discharge nozzles (142, FIG. 2A) into the cold air plenums (136) be the same for each product cell 122 (FIG. 2A) so that the rate of chilling/freezing of product in the product bottles "B" be the same for every bottle. To that end, it is desirable to be able to adjust the amount of air moving through the cold air distribution system 130 at various points in order to achieve this equality of flow from all nozzles (142). One arrangement for doing this by the use of valves is depicted in the alternative cold air distribution system 230 of FIG. 3. FIG. 3 depicts in isometric arrangement three primary cold air supply lines 232A, 232B and 232C, each of which are provided with cold air by the blower 110 of FIG. 1. Only one valve arrangement is shown in FIG. 3 for the primary air supply line 232A, but it is understood that similar valving can be provided for primary air supply lines 232B and 232C. (It will also be apparent that additional primary air supply lines 232 can be added to the air supply system 230.) The air supply system 230 is further provided with three secondary air supply lines 234A, 234B and 234C, each of which are provided with air from the primary air supply line 232A. The primary air supply line 232A can be provided with primary air flow line restricting valves 260 between each of the branches to the secondary supply lines 234. Also, each secondary air supply line 234 can be provided with a dedicated secondary air flow line restricting valve 262. Moreover, each "tee" fitting 240 providing air to the cold air plenum 136 for each product cell (122, FIG. 2A) can be provided with a dedicated product cell air flow restricting valve 264. In this way the flow of air through the air supply system 230 can be adjusted at all points of air flow diversion in order to achieve the desired air flow to each product cell 122 in the rapid freeze cabinet 100 of FIG. 1. While in some instances it is desirable that the rate of airflow to each product cell 122 (FIG. 1) be the same, in some instances it is desirable that the air flow rate be different for different product cells (as described below). The various valves described above can be used to adjust the air flow distribution throughout the rapid freeze cabinet and, once that desired airflow is achieved, the valves can be permanently set so that the airflow does not vary due to drifting of the valve settings. One way this can be achieved is if the valves are made from PVC, in which case the valves can be locked to a particular setting by gluing the valve handle or valve stem to the valve body. Other means of locking the valves to a particular setting can also be used, such as set screws, cotter pins, etc.

Figure 4:
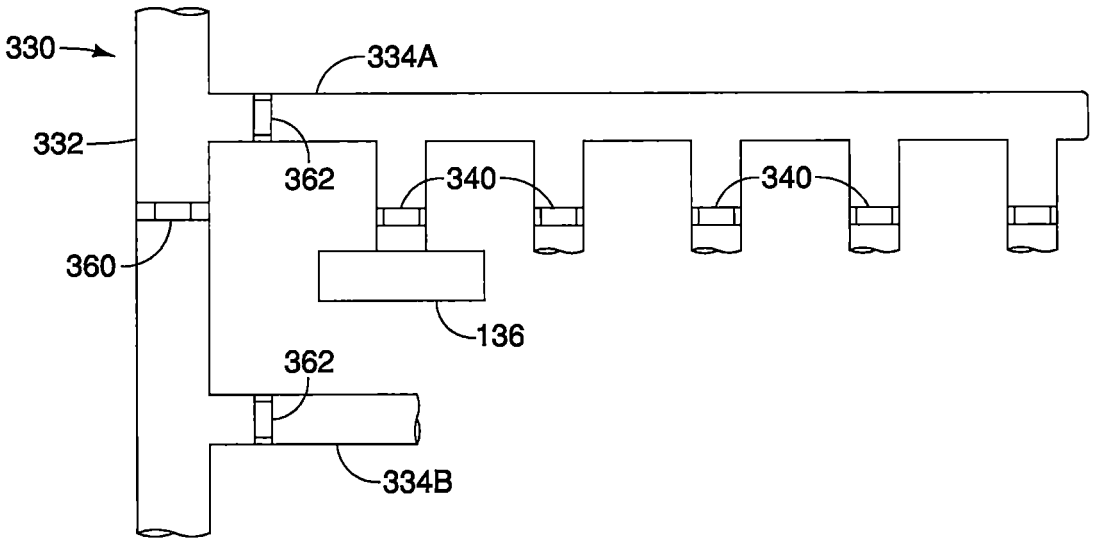
FIG. 4 is a partial side view piping diagram depicting a variation on the cold air distribution system of the rapid freeze cabinet of FIG. 1.

An alternative to the cold air supply system 230 is depicted in a partial side view piping diagram in FIG. 4. The cold air supply system 330 of FIG. 4 uses restricting orifices in place of the various values deployed in the arrangement depicted in FIG. 3. Specifically, primary cold air supply line 332 is provided with restricting orifice plate 360 between the branches to the secondary cold air supply lines 334A and 334B, and each of the secondary cold air supply lines are provided with a restricting orifice plate 362. Further, the lateral branches from the secondary cold air supply line 334A which lead to the cold air plenums 136 (only one of which is shown in FIG. 4) are each provided with a restricting orifice plate 340. (It will be appreciated that the same arrangement is provided for secondary cold air supply line 334B.) In another variation (not depicted in the drawings) the cold air supply system (130, FIG. 1) can be provided with a combination of valves, restricting orifice plates, other types of flow restricting devices, and/or unrestricted lines. Beyond being used to establish homogeneous flow rates in the product cells of the rapid freeze cabinet, the use of valves and/or orifice plates in the cold air distribution system can also be used to establish different cold air flow rates between product cells, as for example to accommodate different sizes of product bottles, or to accommodate different types of products from one cell (or product drawer) to another. The use of valves (described in FIG. 4) within the cold air distribution system also allows sections of the cabinet, or specific product drawers, to be isolated from air flow in the event that the isolated portion of the cabinet is not being used at some specific time. Further, the use of valves in the cold air distribution system allows the rate of cooling of product to be varied. Specifically, certain products need to be chilled to a specific temperature within a certain period of time. If the air flow capacity from the blower (110, FIG. 1) exceeds the required amount of air flow in order to achieve the desired chilling, then the air flow can be throttled using the valves, thus reducing energy consumption of the system. If different products are placed within the cabinet and have different cooling rate requirements, then this can be accommodated using the valves. In this way the cabinet 200 (described below with respect to FIGS. 9 and 10) not only can perform rapid freezing and/or chilling product, but also controlled rapid freezing/chilling of product. This control extends not only to the cabinet as an overall unit, but indeed to each product cell within the overall cabinet.

Figure 5:
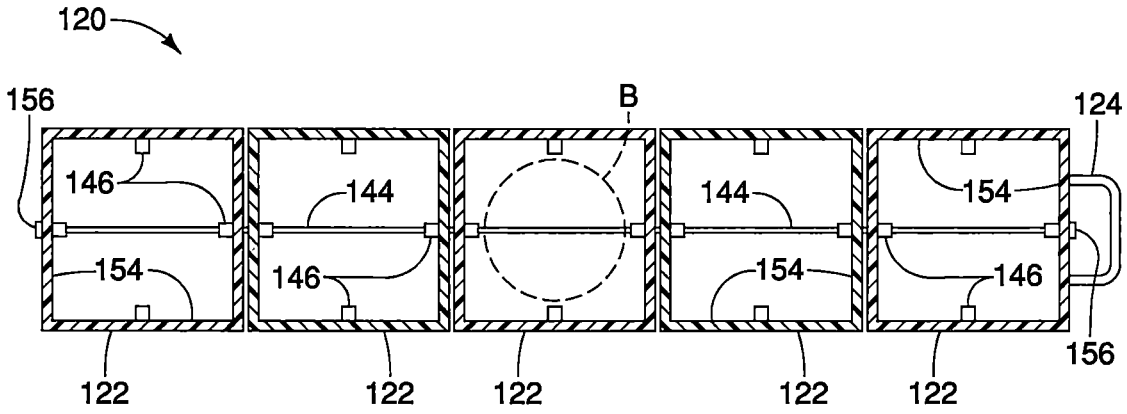
FIG. 5 is a sectional plan view of the product drawer used in the rapid freeze cabinet of FIG. 1.

With reference now to FIG. 5, the product drawer 120 used in the rapid freeze cabinet of FIG. 1 is shown in a sectional plan view. The product drawer 120 includes five product cells 122 which are joined together in a straight line. In this example the product cells 122 are fabricated from square extruded polyvinyl chloride (PVC) tubing, cut into sections of the desired length to hold the product bottles "B" (see FIG. 2A). Each product cell 122 thus has four sidewalls 154, and the product cells can be joined together by gluing or other means. The product drawer 120 further includes a product bottle support rod 144 which passes through all five of the product cells 122 (also see FIG. 2A for positioning of the support rod in the product cell), and the support rod can also be used to join the product cells together in side-by-side arrangement. The support rod 144 can be a metal rod with threaded ends, held in place by fasteners 156 at the opposite ends of the product drawer 120. Each product cell 122 also includes four product bottle spacers 146. The product bottle spacers 146 can be plastic or metal pins inserted through holes drilled in the walls 154 of the product cells 122, and glued or otherwise secured in place. An exemplary bottle "B" is depicted in plan view by phantom lines in the center product cell 122 of the product drawer 120.

Figure 6:
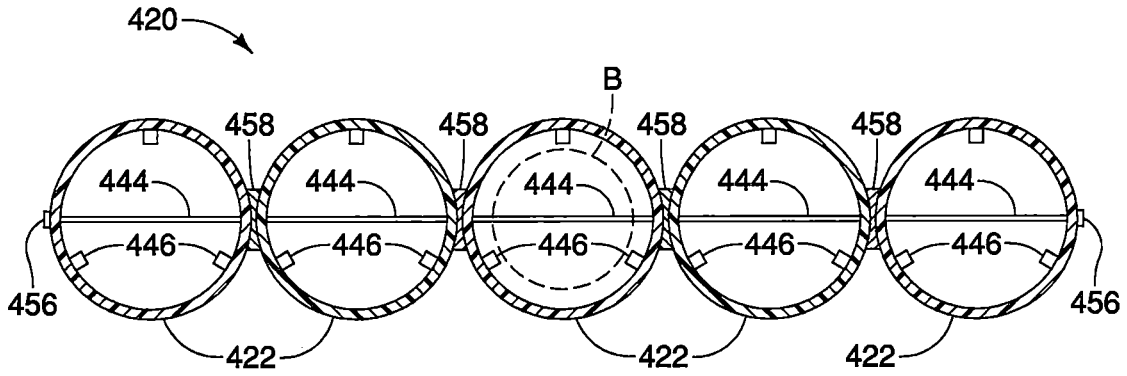
FIG. 6 is a plan view of an alternative product drawer that can be used in the rapid freeze cabinet of FIG. 1.

FIG. 6 is a plan view of an alternative product drawer 420 that can be used in the rapid freeze cabinet of FIG. 1. The product drawer 420 has five product cells 422, which are circular in cross section. In side view, the product cells 422 of FIG. 6 will be indistinguishable from the square product cells 122 of FIG. 5 (see also FIG. 2A). The product cells 422 of FIG. 6 can be fabricated from round PVC tubing or pipe, cut to the desired length to accommodate the product bottle. The product cells 422 can be joined to one another by the product bottle support rod 444 which runs the length of the product drawer 420 and is disposed near the bottom of the product cells 422, and is secured at each end by product rod fasteners 456. As depicted in FIG. 6, each product cell 422 is provided with three product bottle spacers 446 which are evenly spaced apart in a radial disposition along the inner wall of the product cell. An exemplary bottle "B" is depicted in plan view by phantom lines in the center product cell 422 of the product drawer 420. In one variation the circular product cells 422 can be necked-down in diameter towards the middle of the product bottle "B" to form a venturi-shaped product cell, which will accelerate air within the product cell moving past the product bottle, thus increasing the rate of heat extraction from the bottle by the moving air.

Figure 7:
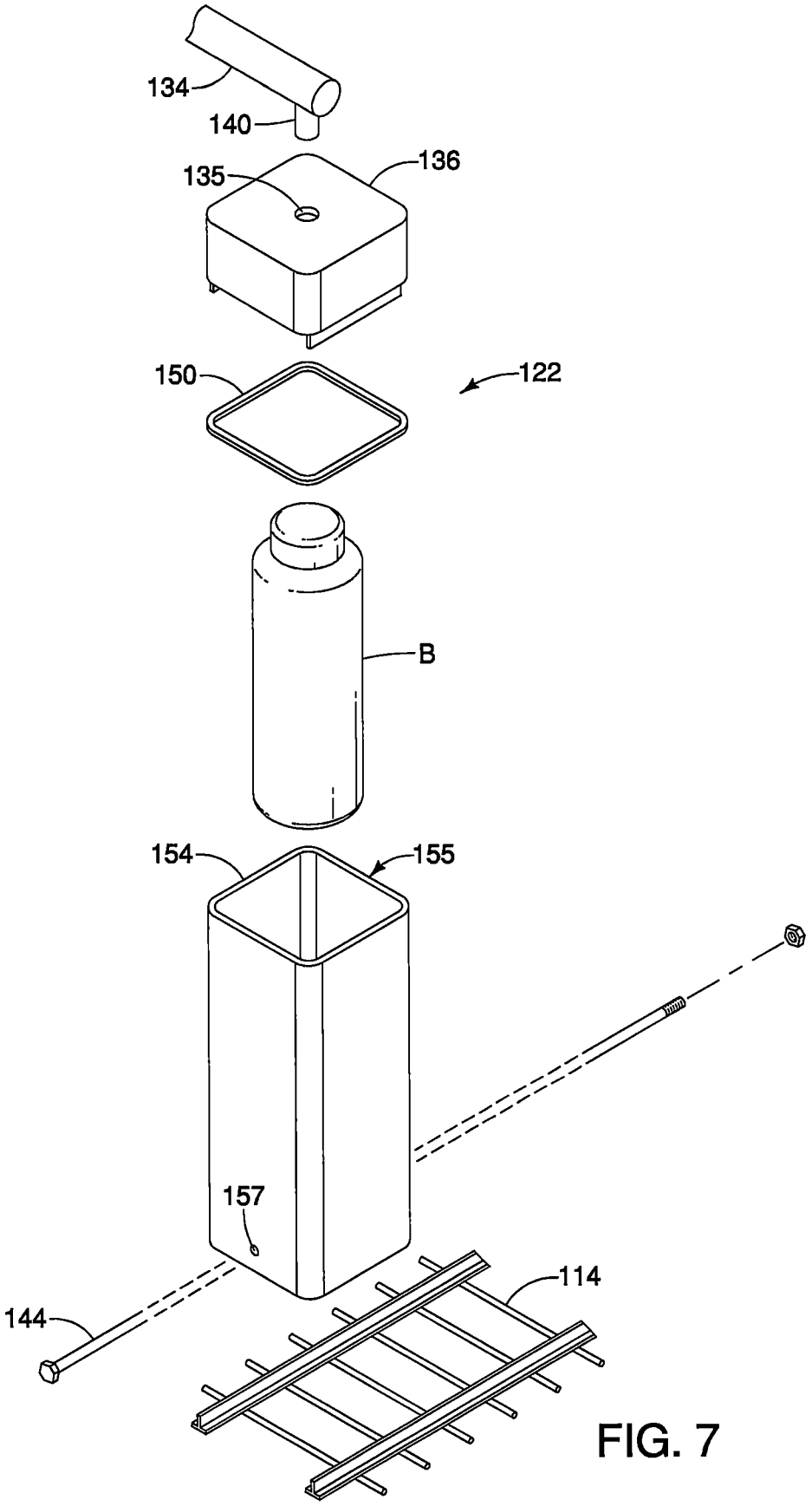
FIG. 7 is an exploded isometric view depicting a product cell from the rapid freeze cabinet of FIG. 1.

FIG. 7 is an exploded isometric view depicting a product cell 122 from the apparatus of FIGS. 1 and 2A. The product cell 122 includes a main body 155, which here is an extruded PVC segment having a generally square cross section (per FIG. 5) defining four sidewalls 154. The product bottle support rod 144 is inserted through holes 157 on opposite sides of the product cell main body 155 towards the lower end of the main body. The seal 150 fits around the upper periphery of the main body 155 and forms a seal between the main body and the plenum 136. Fitting 140 from the secondary cold air supply line 134 is fitted over an air opening 135 in the upper portion of the plenum 136. Not visible in FIG. 7 is the cold air discharge nozzle 142 inside the plenum (see FIG. 2A). Also depicted in FIG. 7 for reference sake is a product bottle "B" and a segment of the shelf 114 upon which the product cell 122 rests while in the cabinet 100 of FIG. 1.

Figure 8:
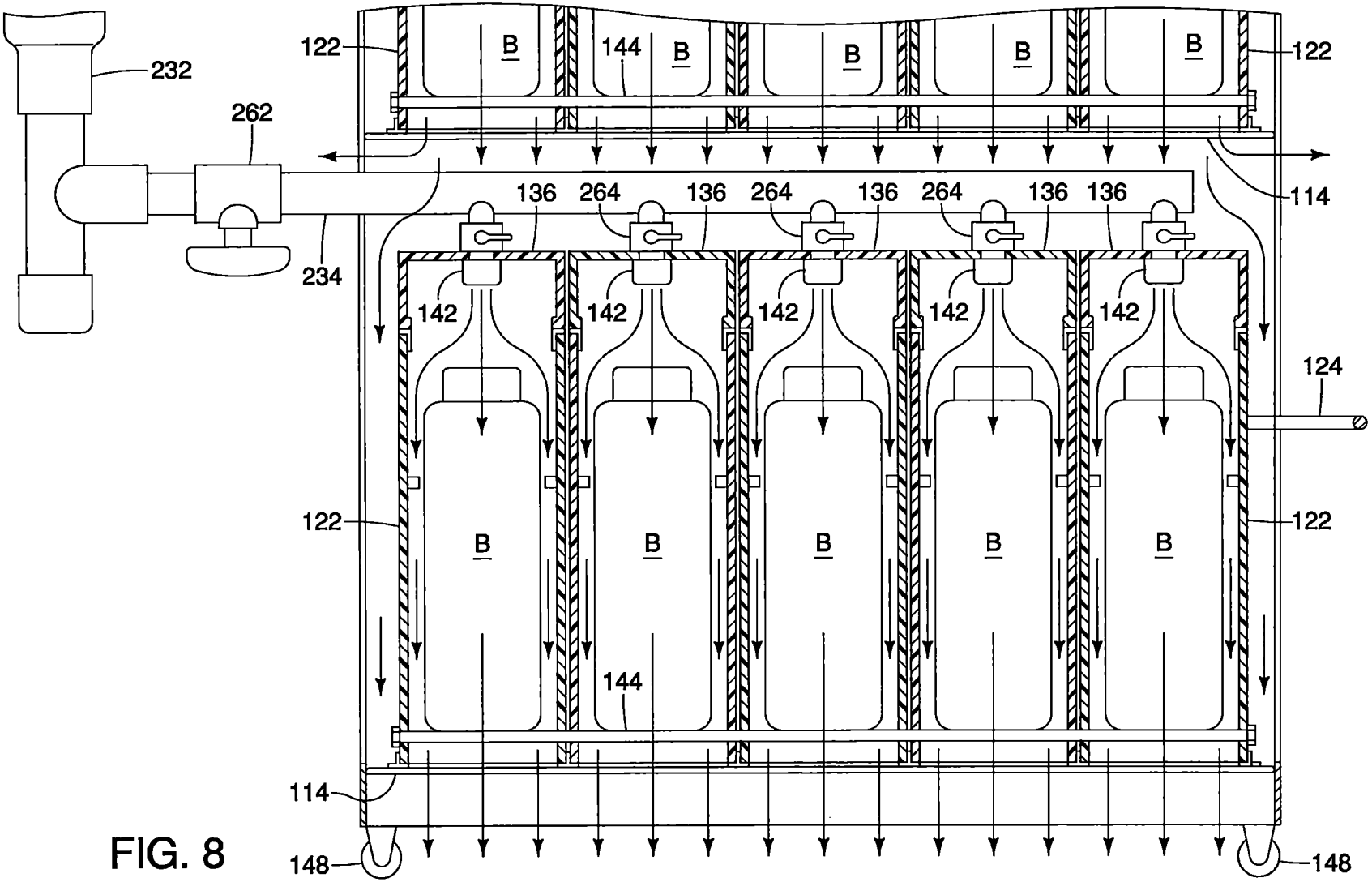
FIG. 8 is a sectional side view of the lower left side of the rapid freeze cabinet of FIG. 1, but using the alternative cold air distribution system of FIG. 3.

FIG. 8 is a sectional side view of the lower left side of the rapid freeze cabinet 100 of FIG. 1, but using the alternative cold air distribution system 230 of FIG. 3. Specifically, the primary cold air supply line 232 tees into the secondary air supply line 234 via main tee 233, with secondary air flow line restricting valve 262 disposed between the tee fitting 233 and the secondary line 234. Further, secondary "tee" fittings 240 provide air from the secondary cold air line 234 to the cold air plenums 136 for each product cell 122, with product cell air flow restricting valves 264 disposed between the secondary tees 240 and the cold air discharge nozzles 142. Also depicted in FIG. 8 is the shelf 114 upon which rests the product drawer 120, exemplary product bottles "B", and drawer pull 124 for extracting the product drawer 120 from the cabinet.

Figure 9:
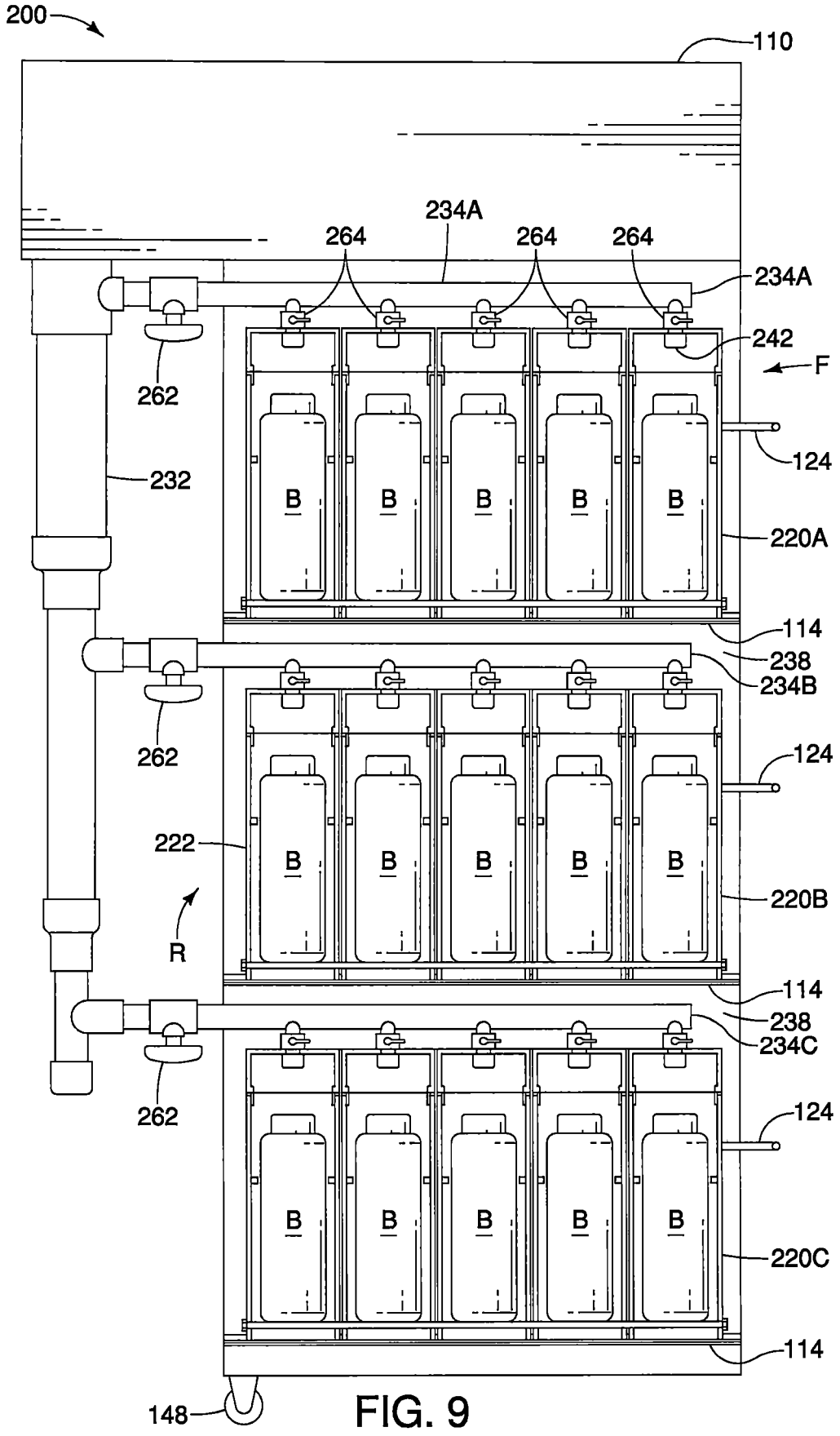
FIG. 9 is a left side view of a rapid freeze cabinet using the alternative cold air distribution system of FIG. 3.
Figure 10:
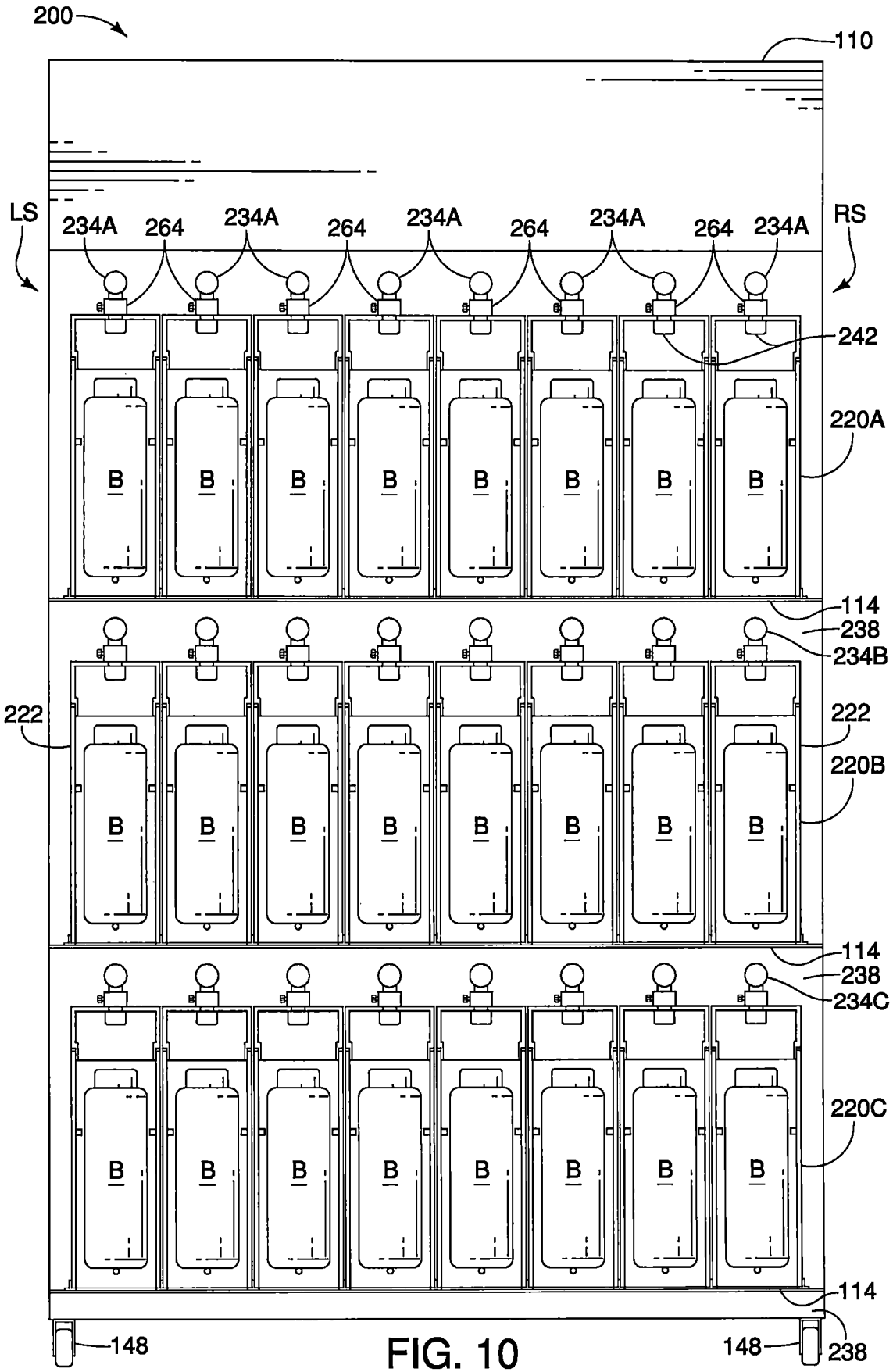
FIG. 10 is a front side view of the rapid freeze cabinet of FIG. 9.

FIGS. 9 and 10 together depict respective left side and front views of a rapid freeze cabinet 200, which uses the alternative cold air distribution system 230 of FIG. 3. In FIGS. 9 and 10 the product cells 222 are depicted in sectional view so that exemplary product bottles "B" can be seen, as well as the cold air discharge nozzles 242. Otherwise, the rapid freeze cabinet 200 is depicted in true side and front views (respectively) in FIGS. 9 and 10. That is, when the cabinet 200 is viewed from the side, there are no sidewalls to obstruct the view of the product drawers (220A, 220B, 220C). This open-sided configuration of the cabinet 200 allows air which is discharged from the bottom of the product cells 222 to freely exit the cabinet (i.e., as per the front view of FIG. 10, from the left side "LS" and the right side "RS" of cabinet 200). The free flow of discharged cooling air from the product cells 222 allows the configuration of the cabinet 200 to achieve rapid freezing (or cooling) of product in the product bottles "B" placed within the product cells 222.

The rapid freeze cabinet 200 is configured with three tiers of product drawers, as indicated by product drawers 220A (top or upper tier), 220B (middle tier), and 220C (bottom or lower tier), as seen in both FIGS. 9 and 10. Further, as depicted in FIG. 10, each tier of the rapid freeze cabinet 200 is provided with eight product drawers (generally, 220). Thus, the cabinet 200 can hold 120 bottles "B" (eight rows of drawers across, by three tiers of drawers, and five bottles per drawer, for a total of 120 bottles) for rapid freezing of product. In FIG. 9 one of the primary cold air supply lines 232 can be seen in side view. As indicated above with respect to FIG. 3, there will be one primary cold air supply line 232 for each row of drawers 220—so in this example there will be eight primary cold air supply lines 232 distributed across the back or rear "R" of the cabinet 200. Also as can be seen in FIG. 9, each primary cold air supply line 232 has three secondary cold air supply lines (234A, 234B and 234C) attached thereto—i.e., one secondary supply line (generally, 234) for each of the three tiers of the cabinet 200. Thus, in this example there will be twenty four secondary cold air supply lines 234 overall—i.e., one secondary cold air supply line for each product drawer 220 (three tiers of drawers times eight rows of drawers, for a total of 24 drawers). Each secondary cold air supply line 234 is provided with a secondary air flow line restricting valve 262 placed prior to the product cells 222 so that air flow between the three tiers of product drawers 220 can be regulated (as described above with respect to FIG. 3). Also, each secondary cold air supply line 234 is provided with a dedicated product cell air flow restricting valve 264 placed in-line with the cold air discharge nozzle 242 for each product cell (see FIG. 8 for more detail). The product cell air flow restricting valves 264 allow the amount of cold air provided to each product cell 222 within a particular product drawer 220 to be regulated. The rapid freeze cabinet 200 also includes the cold air blower 110 which takes in cold air at the top of the blower and discharges the cold air to the primary cold air supply lines 232. As with the cabinet 100 of FIG. 1, in FIG. 9 the product drawers 220 are supported on shelves 114, which are configured to be open shelves to allow the free flow of air there-through. (In one example the shelves 114 are fabricated from thin metal rods which are welded together to provide sufficient strength to support the product drawers 220.) The spacing between the tiers of drawers 220 provide air outlet openings 238 in the front "F" (and rear "R") of the rapid freeze cabinet 200 to facilitate the quick and unobstructed flow of discharged air from the product cells 222 to the exterior environment (i.e., outside of the cabinet). It will be appreciated that the left and right sides ("LS", "RS" respectively) of the rapid freeze cabinet 200 can be referred to as respective "first and second" sides, while the front and rear sides ("F", "R", respectively) can be referred to as respective "third and fourth" sides of the cabinet, the third and fourth sides being orthogonal to the first and second sides.

As described above, the rapid freeze cabinet provided for herein can be placed within, and removed from, a main freezer or cooler (e.g., using wheels 148 on the cabinet 100 of FIG. 1). In one variation the rapid freeze cabinet (e.g., cabinet 200 of FIGS. 9 and 10) can be a fixed unit as part of the main freezer/cooler. In this instance, the front of the cabinet (e.g., "F" of cabinet 200 of FIG. 9) can be an exterior surface of the main freezer/cooler, and in order to prevent cold air from the main freezer/cooler escaping from the main freezer via the cabinet 200, the discharge air openings 238 in the front of the cabinet can be sealed. (Or, put another way, to reduce warm air infiltration into the main freezer/cooler via the cabinet 200.) Further, the front of the cabinet 200, and the front portions of the product drawers 220, can be provided with thermal insulation to reduce heat intrusion (warm air infiltration) into the main freezer/cooler via the front of the cabinet 200. This arrangement (of installing the rapid freeze/cooler cabinet as part of a main walk-in freezer or cooler) reduces warm air intrusion into the main freezer/ cooler whenever individuals need to place product within, or remove product from, the rapid freeze/cooler cabinet. This arrangement also reduces exposure of workers accessing the cabinet to the extreme cold of the air in the main freezer/cooler (i.e., individuals no longer need to enter the main freezer to access the rapid freeze/cooler cabinet.).

Returning now to FIG. 2A, as described above the cold air discharge nozzle 142 can be configured to facilitate distribution of the cooling air to the space between the product bottle "B" and the sidewall of the product cell 122. A commercially available air nozzle which provides a hollow cone discharge of air, and can be used for the cold air discharge nozzle 142, is manufactured by Bete of Greenfield MA, US, as part of their NCJ product line.

The preceding description has been presented only to illustrate and describe exemplary methods and apparatus of the present invention. It is not intended to be exhaustive or to limit the disclosure to any precise form disclosed. Many modifications and variations are possible in light of the above teaching. It is intended that the scope of the invention be defined by the following claims.

I claim:

1. A rapid freeze cabinet, comprising:

an open frame structure comprising a horizontally disposed rectangular upper frame;

a horizontally disposed rectangular lower frame;

four vertically disposed side frame members connected to the upper frame and the lower frame to thereby form the open frame structure as a rectangular parallelepiped;

a blower disposed on the upper frame, the blower having a cold air discharge;

a product drawer shelf disposed within the open frame structure between the upper frame and the lower frame, the product drawer shelf supported by the side frame members, the product drawer shelf defining shelf openings to allow passage of air therethrough;

a product drawer slidingly disposed on the product drawer shelf, the product drawer comprising a plurality of product cells configured to support a plurality of product containers, each product cell having an open upper end, an open lower end, closed sidewalls, a product container support member disposed within the product cell proximate the open lower end of the product cell, and a plurality of product container spacers disposed within the product cell proximate the upper end of the product cell; and a cold air distribution system, comprising:

a cold air supply line having a first end connected to the cold air discharge of the blower, and a second end attached to a plurality of cold air discharge nozzles, each cold air discharge nozzle disposed above a respective product cell when the product drawer is disposed within the open frame structure; and a plurality of cold air plenums, each cold air plenum housing a respective cold air discharge nozzle and forming a seal around the open upper end of a respective product cell.

2. The rapid freeze cabinet of claim 1, and wherein: the upper frame, the lower frame and the four vertically disposed side frame members define opposing first and second sides of the open frame structure, each of the first and second sides of the open frame structure being defined by a respective first and second side area, and further wherein each of the first and second side areas is at least 75% open space to thereby facilitate the flow of air through the first and second sides of the open frame structure.

3. The rapid freeze cabinet of claim 2, and wherein: the upper frame, the lower frame and the four vertically disposed side frame members define opposing front and back sides of the open frame structure, each of the front and back sides of the open frame structure being defined by a respective front and back side area, and further wherein each of the front and back side areas is at least 75% open space to thereby facilitate the flow of air through the front and back sides of the open frame structure.

4. The rapid freeze cabinet of claim 1, and wherein the product drawer shelf is a first product drawer shelf, the rapid freeze cabinet further comprising:

a second product drawer shelf disposed within the open frame structure between the upper frame and the lower frame, the second product drawer shelf supported by the side frame members, and being spaced-apart from the first product drawer shelf, the second product drawer shelf defining shelf openings to allow passage of air therethrough.

5. The rapid freeze cabinet of claim 1, and further comprising a plurality of product cell air flow restricting valves, each product cell air flow restricting valve being disposed between the cold air supply line and an associated cold air discharge nozzle of the plurality of cold air discharge nozzles.

* * * * *